US008439713B2

(12) United States Patent
Chiu et al.

(10) Patent No.: US 8,439,713 B2
(45) Date of Patent: May 14, 2013

(54) HIGH-POWER CONNECTOR HAVING HEAT DISSIPATION STRUCTURE

(75) Inventors: Hsien-Yu Chiu, Taoyuan Hsien (TW); Shin-Way Lin, Taoyuan Hsien (TW); Han-Min Chu, Taoyuan Hsien (TW)

(73) Assignee: Simula Technology Inc., Taoyuan Hsien (TW)

( * ) Notice: Subject to any disclaimer, the term of this patent is extended or adjusted under 35 U.S.C. 154(b) by 0 days.

(21) Appl. No.: 13/362,421

(22) Filed: Jan. 31, 2012

(65) Prior Publication Data

US 2012/0214331 A1 Aug. 23, 2012

(30) Foreign Application Priority Data

Feb. 21, 2011 (TW) ..... 100105578 A

(51) Int. Cl.
*H01R 13/2442* (2006.01)

(52) U.S. Cl.
USPC ..... 439/862

(58) Field of Classification Search ..... 439/862, 439/66, 83, 74, 67, 515
See application file for complete search history.

(56) References Cited

U.S. PATENT DOCUMENTS

| | | | | |
|---|---|---|---|---|
| 6,915,488 | B2 * | 7/2005 | Omori et al. | 715/773 |
| 7,357,665 | B1 * | 4/2008 | Yan | 439/500 |
| D571,723 | S * | 6/2008 | Chen et al. | D13/120 |
| 7,628,660 | B2 * | 12/2009 | Ma | 439/862 |
| 7,803,011 | B1 * | 9/2010 | Mai | 439/500 |

* cited by examiner

*Primary Examiner* — Tulsidas C Patel
*Assistant Examiner* — Phuongchi Nguyen
(74) *Attorney, Agent, or Firm* — Bacon & Thomas, PLLC

(57) ABSTRACT

The present invention is to provide a high-power connector having a heat dissipation structure, which includes a cover, a plurality of resilient metal terminals and a plurality of auxiliary metal plates. The cover is made of an insulating material and defines a plurality of receiving spaces therein. The resilient metal terminals are fitted in the receiving spaces respectively. The front section of each resilient metal terminal has an arcuate shape, passes through a lateral side of the cover, and is exposed from the cover. The front section of each auxiliary metal plate is electrically connected to the corresponding resilient metal terminal, and the rear section of each auxiliary metal plate is electrically connected to a circuit board. Since the auxiliary metal plates have relatively low impedance capable of rapidly releasing the heat generated by the connector, the components of the connector are prevented from premature aging attributable to high temperature.

11 Claims, 5 Drawing Sheets

HIGH-POWER CONNECTOR HAVING HEAT DISSIPATION STRUCTURE

FIELD OF THE INVENTION

The present invention relates to an electrical connector, more particularly to a high-power connector having a heat dissipation structure, which includes a plurality of auxiliary metal plates each having relatively low impedance for rapidly releasing the heat generated by the high-power connector to the outside and thus preventing the components of the high-power connector from premature aging attributable to high temperature.

BACKGROUND OF THE INVENTION

With the improvement of people's living standard, one who wishes to buy a certain electronic product would pay as much attention to the physical appearance of the electronic product as to the product's functions, and this is especially true of consumer electronics such as mobile phones, personal digital assistants (PDAs), and tablet PCs. Nowadays, with a view to high portability and easy storage, it is generally desired that the physical appearance of a consumer electronic product conform to the design concept of "being slimmer and smaller". On the other hand, high performance is still expected of such electronic products. Therefore, more and more electronic product manufacturers have changed their original product designs in order to meet user needs and secure a position in the market of consumer electronics.

For a consumer electronic product to maintain high performance, the product's electronic components (e.g., connectors) must be capable of high-density energy transmission. Nevertheless, the energy (e.g., electricity) being transmitted generates heat due to the impedance of the transmission path (e.g., metal terminals), and the amount of heat thus generated is in direct proportion to the energy transmission density. In other words, a consumer electronic product capable of high-density energy transmission must generate considerable heat. Further, as a consumer electronic product is downsized, so must be its electronic components; otherwise, the desired variety of electronic components (e.g., connectors, resistors, capacitors, etc.) cannot be fitted into the product's limited interior space. However, the downsizing of the electronic components not only increases the design complexity of the consumer electronic product, but also gives rise to heat management issues that need to be addressed during the design phase, for the impedance of a metal terminal increases as the thickness, and hence the cross-sectional area, of the terminal is reduced.

For instance, the battery capacity of a mobile phone (i.e., a consumer electronic product) must be significantly increased if it is desired to extend the standby time of the mobile phone and to allow multiple application programs of the mobile phone to remain in operation for a longer period of time. Nonetheless, a larger battery capacity means a larger supply current from the battery and consequently a larger amount of heat generated by the connector electrically connected to the battery. As previously mentioned, given the trend toward miniaturization of consumer electronics, existing connectors are only downsized proportionally but are not modified in structural design; hence, these connectors suffer from low heat dissipation efficiency. The shortcomings of existing connector designs are now explained in further detail with reference to a conventional connector whose sectional view is presented in FIG. 1.

FIG. 1 shows a connector 1 for a battery, wherein the connector 1 includes a cover 11 and a plurality of metal terminals 13. The cover 11 is installed on a circuit board 15 and defines a plurality of receiving spaces 111 therein. Each metal terminal 13 is bent into a wavy configuration and fitted in a corresponding one of the receiving spaces 111. The front section of each metal terminal 13 passes through a lateral side of the cover 11 and is exposed from the cover 11. Meanwhile, the rear section of each metal terminal 13 is connected to a metal contact 151 of the circuit board 15. Thus, when the front sections of the metal terminals 13 are connected to the electrode terminals of a battery, the supply current of the battery can flow to the circuit board 15 by way of the metal terminals 13. However, as stated before, the larger the supply current of the battery is, the more heat each metal terminal 13 will generate. Now that the middle section of each metal terminal 13 provides a relatively large area for heat dissipation but is encased in the cover 11, the heat dissipated from the metal terminals 13 will accumulate in the cover 11, which is nevertheless made of a plastic material and therefore incapable of effective heat exchange with the ambient air. As a result, the heat accumulated in the connector 1 cannot be efficiently dissipated, and the temperature of the entire connector 1 rises rapidly, thus not only subjecting the components of the connector 1 to the risks of premature aging caused by extended exposure to high heat, but also shortening the service lives of the electronic components adjacent to the connector 1.

In addition, referring to FIG. 1, the huge amount of heat accumulated in the connector 1 will accelerate oxidation of the metal terminals 13 respectively enclosed in the receiving spaces 111. Once the metal terminals 13 are oxidized, their impedance increases, and more heat is generated by the metal terminals 13. This vicious circle will cut short the service life of the consumer electronic product equipped with the connector 1 and impair the quality of all products using such a connector. Consequently, the manufacturers will have to face customer complaints or even loss of customers.

To sum up, the structures of the conventional connectors have not been changed according to the current design trend of consumer electronics toward smaller and lighter products, so heat accumulation is very likely to occur in the conventional connectors and cause serious heat management problems to those consumer electronic products using such connectors. Therefore, it is an important issue in the electronic industry to design a novel connector which satisfies the size requirements of increasingly smaller consumer electronics, which has better performance than its prior art counterparts, and whose electronic components, though densely packed in a limited space, still allow good heat dissipation.

BRIEF SUMMARY OF THE INVENTION

In view of the fact that the structural designs of the conventional connectors have yet to be modified in accordance with the design trend of consumer electronics toward greater compactness, and that the resultant heat management problems have compromised the service lives and consumer perception of the affected electronic products, the inventor of the present invention conducted extensive research and experiment and finally succeeded in developing a high-power connector with a heat dissipation structure as disclosed herein. The disclosed structure can rapidly release the heat generated by the high-power connector and thus solve the aforementioned problems effectively.

It is an object of the present invention to provide a high-power connector having a heat dissipation structure, wherein the connector takes substantially the same form as the conventional connectors but is additionally provided with a plurality of auxiliary metal plates for reducing the impedance of the high-power connector and thereby significantly extending the connector's service life. The high-power connector includes a cover, a plurality of resilient metal terminals, and a plurality of auxiliary metal plates. The cover is made of an insulating material and defines a plurality of receiving spaces therein. The resilient metal terminals are fitted in the receiving spaces respectively. The front section of each resilient metal terminal has an arcuate shape, passes through a lateral side of the cover, and is exposed from the cover. The front section of each auxiliary metal plate is electrically connected to the corresponding resilient metal terminal, and the rear section of each auxiliary metal plate is electrically connected to a circuit board. As the auxiliary metal plates have relatively low impedance, the components of the high-power connector are prevented from premature aging attributable to high temperature.

It is another object of the present invention to provide the foregoing high-power connector, wherein the rear section of each resilient metal terminal is electrically connected to the circuit board. Thus, each resilient metal terminal and the corresponding auxiliary metal plate form a parallel circuit to reduce the overall impedance of the high-power connector. Moreover, the impedance of each auxiliary metal plate can be lower than that of the corresponding resilient metal terminal. With the auxiliary metal plates having the lower impedance, the electric current in each resilient metal terminal will choose to flow through the corresponding auxiliary metal plate, before reaching the circuit board. Thus, the heat generated by the high-power connector can be effectively reduced.

Still another object of the present invention is to provide the foregoing high-power connector, wherein the connector is inserted through and embedded in the circuit board so as to minimize the space occupied by both the high-power connector and the circuit board. This gives designers more flexibility in planning the circuit space of an electronic device using the high-power connector.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

The inventor of the present invention has long been engaged in the research, development, and manufacture of connectors and like products. In the process, the inventor has found that the structural designs of the conventional connectors tend to cause heat accumulation within the connectors rather than efficient heat dissipation to the ambient air. Hence, the components (e.g., metal terminals) of a conventional connector are very likely to oxidize, and the electronic components adjacent to the connector are also subject to long-term exposure to high heat and may therefore age prematurely. In view of this, the inventor came up with a perfect solution which involves modifying the structural designs of the conventional connectors so that the impedance of a connector is lowered to reduce the heat accumulated in the connector.

Figure 1:
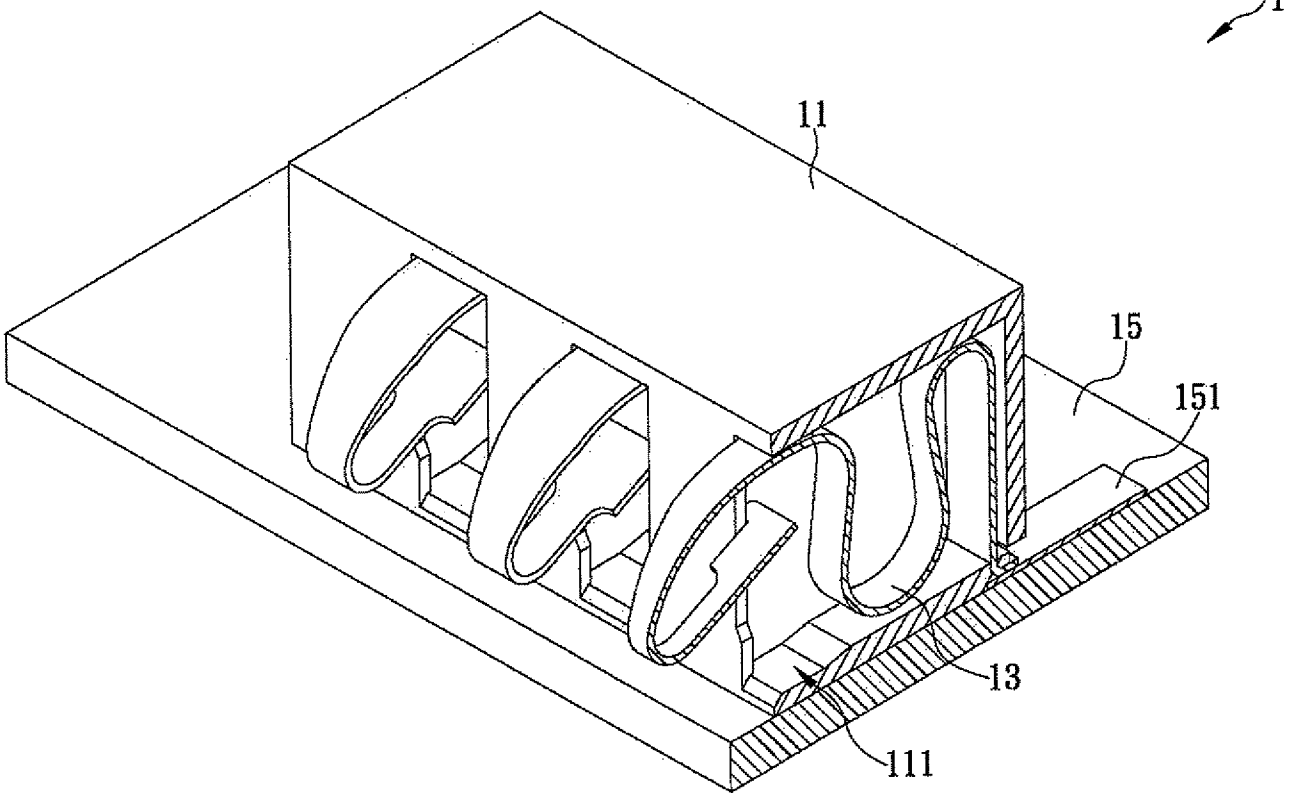
FIG. 1 (Prior Art)
FIG. 1 shows a conventional connector.
Figure 2:
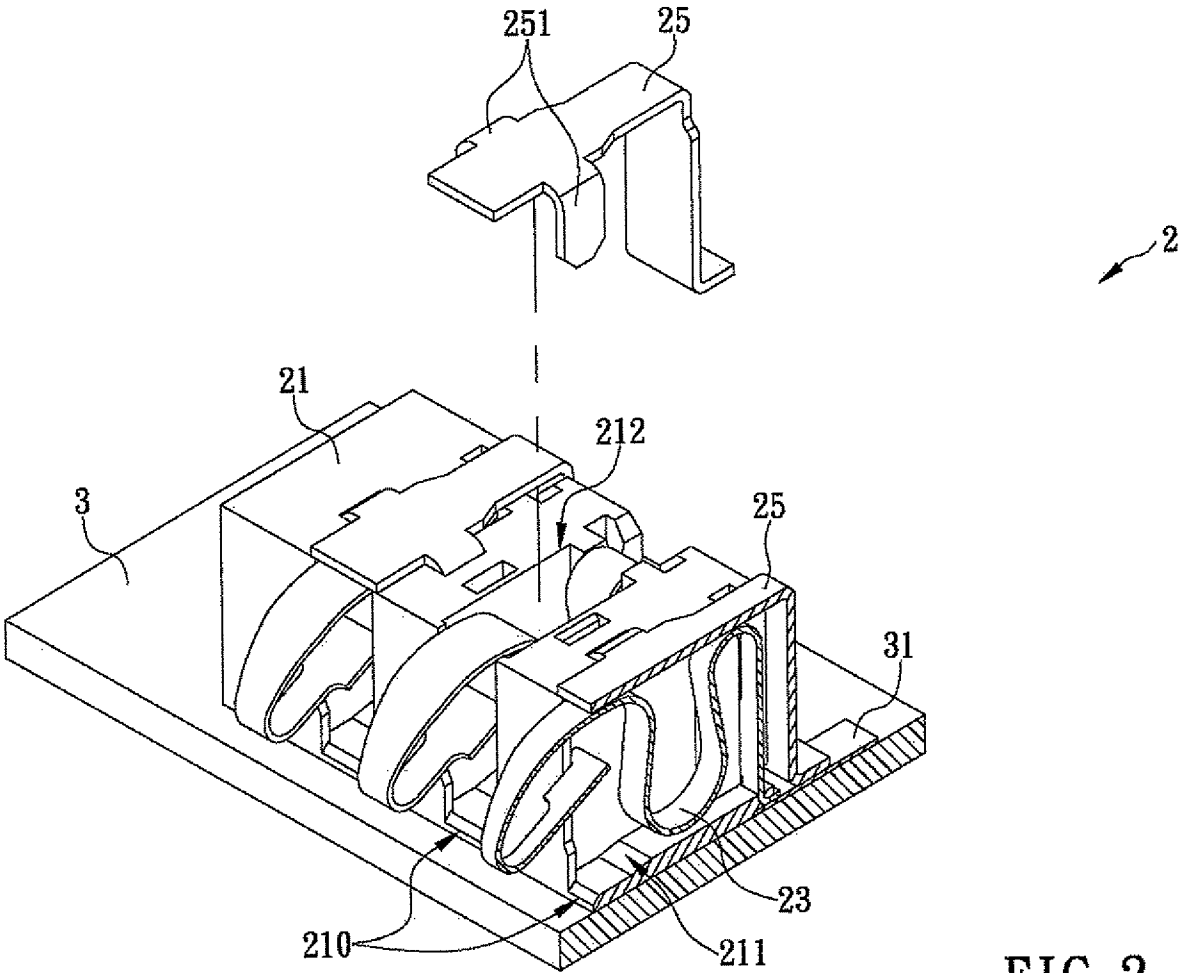
FIG. 2 shows the first embodiment of the present invention.

The present invention discloses a high-power connector having a heat dissipation structure and configured for being installed on a circuit board. In the first embodiment of the present invention as shown in FIG. 2, a high-power connector 2 includes a cover 21, a plurality of resilient metal terminals 23, and a plurality of auxiliary metal plates 25. In order to describe the overall structure of the present invention in detail, the high-power connector 2 is shown in a partial sectional view, and the related electronic components (e.g., resistors, capacitors, etc.) on a circuit board 3 are omitted for the sake of simplicity. The cover 21 is made of an insulating material and fixedly provided on the circuit board 3. The cover 21 has a lateral side formed with a plurality of first openings 210. The cover 21 also defines therein a receiving space 211 corresponding in position to each first opening 210. Besides, the top side of the cover 21 is formed with a plurality of second openings 212 which communicate with the first openings 210 respectively. In the first embodiment, the receiving spaces 211 are independent of one another; in a different embodiment of the present invention, however, the receiving spaces 211 can communicate with one another to suit practical needs. Each resilient metal terminal 23 is bent into a wavy configuration so as to be resiliently deformable or, more particularly, resiliently compressible. Nonetheless, the resilient metal terminals 23 in a different embodiment can be bent into other configurations, provided that the resilient metal terminals 23 are resilient and can be deformed or, more particularly, compressed. The resilient metal terminals 23 are fitted in the receiving spaces 211 and correspond in position to the first openings 210 respectively. The front section of each resilient metal terminal 23 is arcuate and passes through the corresponding first opening 210 of the cover 21 so as to be exposed outside the cover 21. The rear section of each resilient metal terminal 23 is inserted in a bottom side of the cover 21, fixed in the cover 21, and electrically connected to a metal contact 31 of the circuit board 3, so as to transmit or receive electricity or signals to or from the circuit board 3. When the front section of each resilient metal terminal 23 is pressed, the portion of the resilient metal terminal 23 that is adjacent to the front section is deformed and extends toward the corresponding second opening 212.

As shown in FIG. 2, the auxiliary metal plates 25 are provided outside the cover 21 and are spaced apart from one another. The front section of each auxiliary metal plate 25 corresponds in position to one of the second openings 212 and is electrically connected to the corresponding resilient metal terminal 23. The rear section of each auxiliary metal plate 25 is bent and extends toward the circuit board 3 and is electrically connected to the corresponding metal contact 31 of the circuit board 3. In addition, the impedance of each auxiliary metal plate 25 is lower than that of the corresponding resilient metal terminal 23. When the high-power connector 2 is electrically connected to a battery, the front sections of the resilient metal terminals 23 are pressed by the electrode terminals of the battery. As the resilient metal terminals 23 are secured in position and cannot be displaced, the resilient metal terminals 23 undergo compression (i.e., deformation) and generate a resilient restoring force. The resilient restoring force ensures that the front sections of the resilient metal terminals 23 are securely pressed against the electrode terminals, so as for current to flow out of the battery through the resilient metal terminals 23. Moreover, once the resilient metal terminals 23 are compressed (i.e., deformed), the portion of each resilient metal terminal 23 that corresponds in position to the corresponding second opening 212 is moved toward the second opening 212 and pressed tightly against the corresponding auxiliary metal plate 25.

Referring again to FIG. 2, in order to prevent the auxiliary metal plates 25 being pressed from shifting away from their original positions and hindering normal operation of the high-power connector 2, the front section of each auxiliary metal plate 25 is provided with a positioning portion 251. The positioning portions 251 are engaged with the cover 21 to secure the resilient metal plates 25 firmly in position. Thus, the high-power connector 2 in the first embodiment achieves the following advantageous effects:

(1) As the front section and the rear section of each resilient metal terminal 23 are respectively and electrically connected to the front section and the rear section of the corresponding auxiliary metal plate 25, each pair of the connected resilient metal terminal 23 and auxiliary metal plate 25 form a parallel circuit. Given the equation of parallel-connected resistors: total impedance R=(R1*R2)/(R1+R2), where R1 represents the impedance of the resilient metal terminals 23, and R2 represents the impedance of the auxiliary metal plates 25, the overall impedance of the high-power connector 2 is lowered by the parallel connection of each resilient metal terminal 23 and the corresponding auxiliary metal plate 25. Consequently, the heat generated by the high-power connector 2 will be reduced.

(2) With the auxiliary metal plates 25 exposed outside the cover 21, the heat generated by the auxiliary metal plates 25 themselves can dissipate directly to the ambient air and will not accumulate in the cover 21. Thus, the heat dissipation area and heat dissipation efficiency of the high-power connector 2 are greatly increased. Now that the auxiliary metal plates 25 can dissipate heat rapidly, the temperature of the auxiliary metal plates 25 will be lower than that of the resilient metal terminals 23 or the cover 21. Because of that, the auxiliary metal plates 25 can readily absorb the heat generated by the resilient metal terminals 23 and/or the heat conducted from the cover 21 and dissipate the absorbed heat to the ambient air, thereby preventing the service life of the high-power connector 2 from being shortened by premature aging of its components as may otherwise occur due to high temperature.

(3) With the impedance of each auxiliary metal plate 25 being lower than the impedance of the corresponding resilient metal terminal 23, the current in each resilient metal terminal 23 will flow to the circuit board 3 preferentially by way of the corresponding auxiliary metal plate 25. Once the current running through the resilient metal terminals 23 is lowered, the resilient metal terminals 23 generate less heat, and heat accumulation within the cover 21 is thus reduced. On the other hand, the auxiliary metal plates 25 generate more heat, but the heat can dissipate directly to the ambient air and will not accumulate in the cover 21. Therefore, the high-power connector 2 of the present invention features higher heat dissipation efficiency than the conventional connectors.

Figure 3:
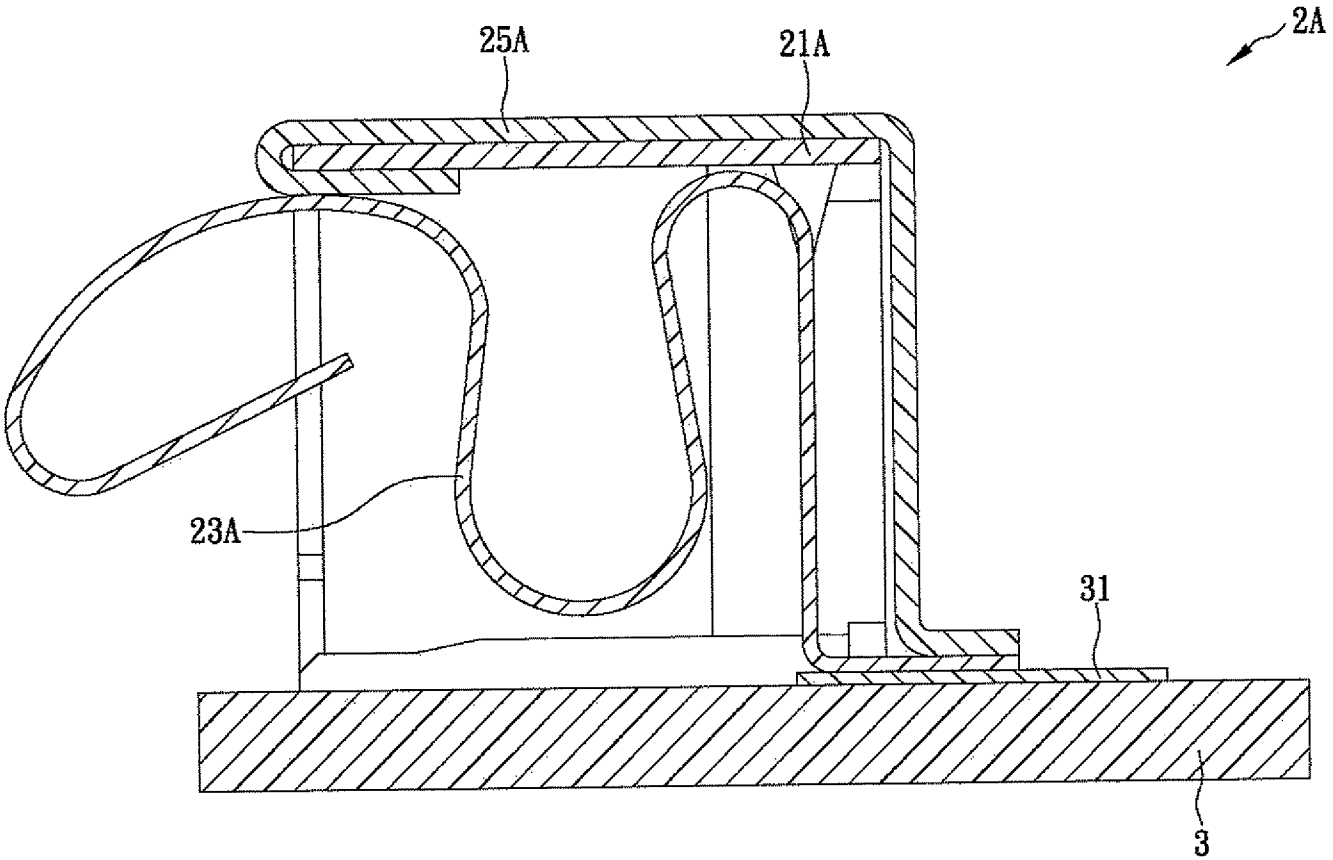
FIG. 3 shows the second embodiment of the present invention.

A person skilled in the art who has fully understood the major technical features of the present invention may modify the configurations of the cover, the resilient metal terminals, and the auxiliary metal plates without departing from the spirit of the present invention. For example, FIG. 3 illustrates an embodiment with such modifications, which embodiment is hereinafter referred to as the second embodiment of the present invention. The second embodiment is the same as the first embodiment except for the cover 21A, the resilient metal terminals 23A, and the auxiliary metal plates 25A, as detailed below. The same parts will not be described repeatedly. The cover 21A has no second openings. The front section of each auxiliary metal plate 25A is bent into the cover 21A so that a portion of the corresponding resilient metal terminal 23A that is adjacent to the front section thereof can press against the auxiliary metal plate 25A. Thus, when the resilient metal terminals 23A are pressed by the electrode terminals of a battery, the supply current of the battery can flow to the auxiliary metal plates 25A through the resilient metal terminals 23A.

in the second embodiment of the present invention as shown in FIG. 3, the rear section of each resilient metal terminal 23A passes through a lateral side of the cover 21A and is exposed outside the cover 21A so as to be electrically connected to the corresponding metal contact 31 of the circuit board 3. At the same time, the rear section of each auxiliary metal plate 25A is directly attached to the rear section of the corresponding resilient metal terminal 23A so as to be electrically connected to the circuit board 3, allowing the auxiliary metal plates 25A to transmit current to the circuit board 3 through the rear sections of the corresponding resilient metal terminals 23A. It should be pointed out that, while the high-power connector 2A in the second embodiment is illustrated as a battery connector, the high-power connector 2 can also be used as a connector for connecting with the connection terminals of loudspeakers or earphones, so as for the circuit board 3 to transmit electric current or signals to the high-power connector 2A.

Figure 4:
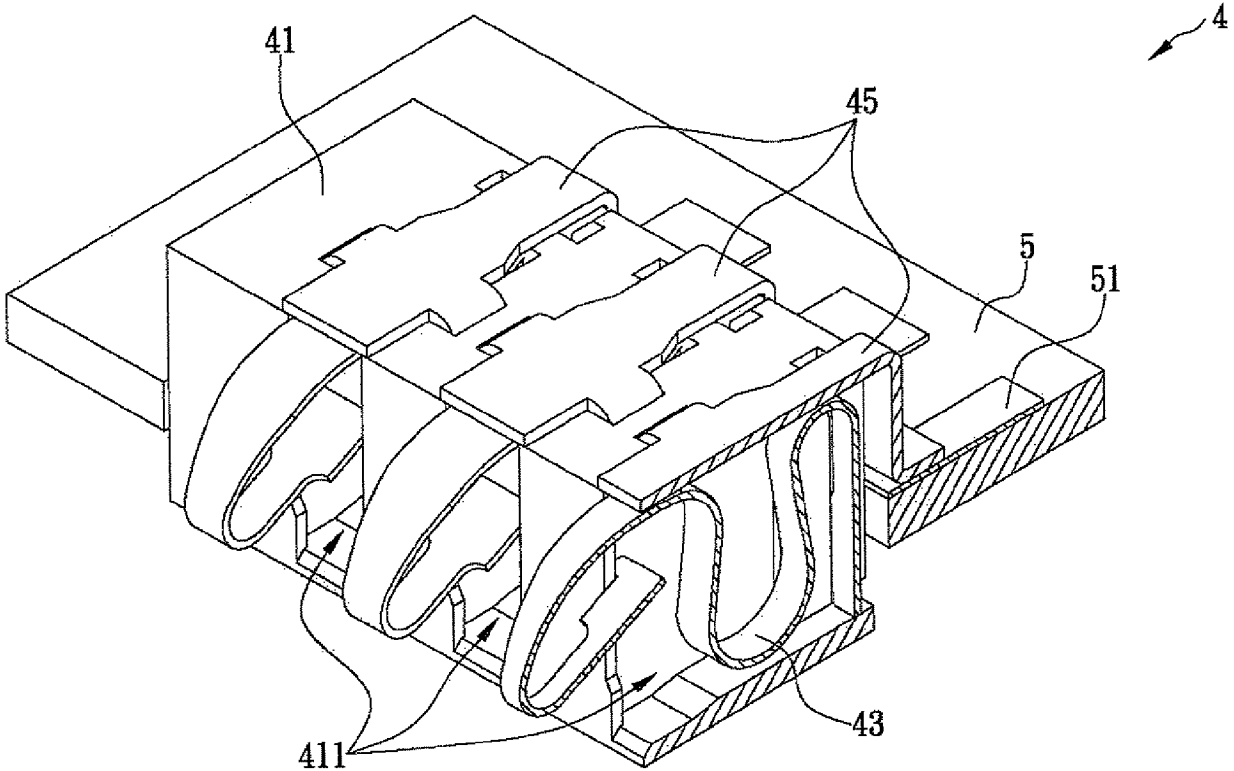
FIG. 4 shows the third embodiment of the present invention.

In the present invention, it is the auxiliary metal plates that serve as the major path for current or signal transmission, with a view to accelerating heat dissipation to the outside. Therefore, depending on design requirements, the high-power connector of the present invention can be configured in such a way that the resilient metal terminals are not electrically connected to the circuit board. Referring to FIG. 4 for the third embodiment of the present invention, the high-power connector 4 includes a cover 41, a plurality of resilient metal terminals 43, and a plurality of auxiliary metal plates 45. The cover 41 forms a plurality of receiving space 411 therein, passes through a circuit board 5, and is embedded in the circuit board 5. Each resilient metal terminal 43 is bent into a wavy configuration and fitted in a corresponding one of the receiving spaces 411. The front section of each resilient metal terminal 43 has an arcuate shape, passes through a lateral side of the cover 41, and is exposed from the cover 41. The rear section of each resilient metal terminal 43 merely presses against the cover 41. On the other hand, the auxiliary metal plates 45 are provided outside the cover 41 and each have a front section electrically connected to the corresponding resilient metal terminal 43 and a rear section electrically connected to a metal contact 51 of the circuit board 5. Thus, the height of the interior circuit space of an electronic product using the high-power connector 4 can be reduced from the combined height of the high-power connector 4 and the circuit board 5 to the height of the high-power connector 4 alone, allowing more flexibility in the planning of circuit space. It should be pointed out that, while the resilient metal terminals 43 in the third embodiment are not electrically connected to the circuit board 5, such electrical connection can be made as needed.

Figure 5:
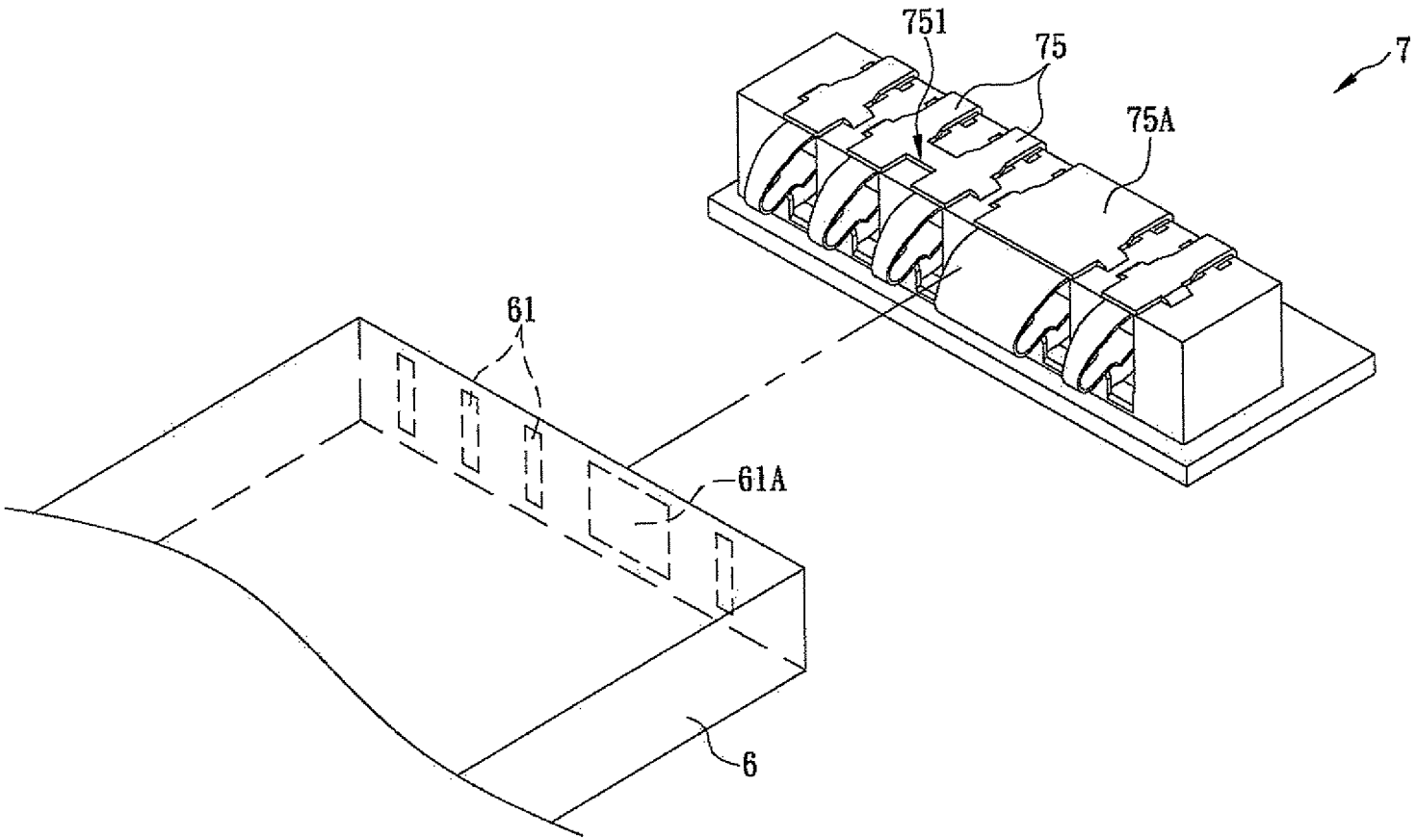
FIG. 5 shows the fourth embodiment of the present invention.

Reference is now made to FIG. 5. The electrode terminals 61 of a conventional battery 6 may have different shapes in order to meet different circuit requirements. For instance, the electrode terminal 61A has a relatively wide area of contact, and the plural electrode terminals 61 belong to the same line and can therefore be viewed as a single electrode terminal 61. In the fourth embodiment of the present invention as shown in FIG. 5, a connecting plate 751 is provided between the two adjacent auxiliary metal plates 75 to add to the widths of the auxiliary metal plates 75, and the auxiliary metal plate 75A itself has a relatively great width to significantly increase the heat dissipation area of the high-power connector 7. Therefore, the high-power connector 7 of the present invention has wide industrial applicability and can satisfy different circuit design requirements, giving the connector designers or manufacturers a competitive edge in the market.

It should be noted that the auxiliary metal plates of the present invention can also be provided inside the cover. As long as the auxiliary metal plates form parallel circuits with the corresponding resilient metal terminals or have lower impedance than the corresponding resilient metal terminals, the heat generated by the high-power connector can be effectively reduced to achieve the objects of the present invention. Besides, the terms used in the description of the foregoing embodiments and the component configurations disclosed herein are explanatory only, with the intention of enabling the general public or those engaged in the related field to rapidly comprehend the substance and essence of the disclosed invention; the terms and the components configurations should not be construed as limitations imposed on the present invention. A person skilled in the art who has fully understood the major technical features of the present invention may change the physical appearances of the components while still achieving the objects of the present invention. Therefore, the scope of patent right, if granted, of the present invention is not restricted to that disclosed herein. All equivalent variations which are based on the disclosed technical contents and easily conceivable by a person of skill in the art should fall within the scope of the present invention.

What is claimed is:

1. A high-power connector having a heat dissipation structure, the high-power connector being installed on a circuit board and comprising:

a cover made of an insulating material and defining therein a plurality of receiving spaces;

a plurality of resilient metal terminals fitted in the receiving spaces respectively, each said resilient metal terminal having a front section which is arcuate, passes through a lateral side of the cover, and is exposed from the cover; and a plurality of auxiliary metal plates, each having a front section electrically connected to a corresponding said resilient metal terminal and a rear section electrically connected to a metal contact of the circuit board;

wherein the auxiliary metal plates are provided outside the cover, and the cover has a top side formed with an opening corresponding in position to the auxiliary metal plates so as for the resilient metal terminals to pass through the opening and press against the corresponding auxiliary metal plates respectively.

2. The high-power connector of claim 1, wherein each said resilient metal terminal has a rear section electrically connected to a corresponding said metal contact of the circuit board.

3. The high-power connector of claim 1, wherein the front section of each said auxiliary metal plate has a positioning portion engaged with the cover.

4. The high-power connector of claim 3, further comprising a connecting plate provided between at least two adjacent said auxiliary metal plates.

5. The high-power connector of claim 4, wherein the cover passes through and is embedded in the circuit board.

6. A high-power connector having a heat dissipation structure, the high-power connector being installed on a circuit board and comprising:

a cover made of an insulating material and defining therein a plurality of receiving spaces;

a plurality of resilient metal terminals fitted in the receiving spaces respectively, each said resilient metal terminal having a front section which is arcuate, passes through a lateral side of the cover, and is exposed from the cover; and a plurality of auxiliary metal plates, each having a front section electrically connected to a corresponding said resilient metal terminal and a rear section electrically connected to a metal contact of the circuit board;

wherein each said resilient metal terminal has a rear section passing through another lateral side of the cover and electrically connected to both a corresponding said metal contact of the circuit board and the rear section of a corresponding said auxiliary metal plate;

wherein the auxiliary metal plates are provided outside the cover, and the cover has a top side formed with an opening corresponding in position to the auxiliary metal plates so as for the resilient metal terminals to pass through the opening and press against the corresponding auxiliary metal plates respectively.

7. The high-power connector of claim 6, wherein the front section of each said auxiliary metal plate has a positioning portion engaged with the cover.

8. The high-power connector of claim 7, further comprising a connecting plate provided between at least two adjacent said auxiliary metal plates.

9. The high-power connector of claim 8, wherein the cover passes through and is embedded in the circuit board.

10. A high-power connector having a heat dissipation structure, the high-power connector being installed on a circuit board and comprising:

a cover made of an insulating material and defining therein a plurality of receiving spaces;

a plurality of resilient metal terminals fitted in the receiving spaces respectively, each said resilient metal terminal having a front section which is arcuate, passes through a lateral side of the cover, and is exposed from the cover; and a plurality of auxiliary metal plates, each having a front section electrically connected to a corresponding said resilient metal terminal and a rear section electrically connected to a metal contact of the circuit board;

wherein the auxiliary metal plates are provided outside the cover, and the front sections of the auxiliary metal plates are bent into the cover so as for the resilient metal terminals to press against the corresponding auxiliary metal plates respectively.

11. A high-power connector having a heat dissipation structure, the high-power connector being installed on a circuit board and comprising:

a cover made of an insulating material and defining therein a plurality of receiving spaces;

a plurality of resilient metal terminals fitted in the receiving spaces respectively, each said resilient metal terminal having a front section which is arcuate, passes through a lateral side of the cover, and is exposed from the cover; and a plurality of auxiliary metal plates, each having a front section electrically connected to a corresponding said resilient metal terminal and a rear section electrically connected to a metal contact of the circuit board;

wherein each said resilient metal terminal has a rear section passing through another lateral side of the cover and electrically connected to both a corresponding said metal contact of the circuit board and the rear section of a corresponding said auxiliary metal plate;

wherein the auxiliary metal plates are provided outside the cover, and the front sections of the auxiliary metal plates are bent into the cover so as for the resilient metal terminals to press against the corresponding auxiliary metal plates respectively.

* * * * *